US008807281B1

(12) United States Patent
Hoffman

(10) Patent No.: US 8,807,281 B1
(45) Date of Patent: Aug. 19, 2014

(54) LADDER RUNG PLUG

(76) Inventor: Lowell F. Hoffman, Issaquah, WA (US)

( * ) Notice: Subject to any disclaimer, the term of this patent is extended or adjusted under 35 U.S.C. 154(b) by 48 days.

(21) Appl. No.: 13/066,523

(22) Filed: Apr. 18, 2011

(51) Int. Cl.
*E06C 5/32* (2006.01)

(52) U.S. Cl.
USPC ..... 182/129; 182/228.6

(58) Field of Classification Search
USPC ..... 182/129, 228.6, 228.3, 228.4
See application file for complete search history.

(56) References Cited

U.S. PATENT DOCUMENTS

| | | | | |
|---|---|---|---|---|
| 2,982,373 | A * | 5/1961 | Hopfeld | 182/228.6 |
| 3,578,027 | A | 5/1971 | Zopfi | |
| 3,807,457 | A | 4/1974 | Logsdon | |
| 4,718,134 | A | 1/1988 | Ashby | |
| 4,972,571 | A | 11/1990 | Cole et al. | |
| D359,294 | S | 6/1995 | Szabo | |
| D367,485 | S | 2/1996 | Szabo et al. | |
| 5,620,109 | A | 4/1997 | Madden | |
| 6,254,045 | B1 * | 7/2001 | Oatsvall | 248/210 |
| 6,352,135 | B1 * | 3/2002 | Jones | 182/129 |
| 6,419,046 | B1 * | 7/2002 | Cubbison | 182/129 |
| 2005/0194213 | A1 * | 9/2005 | Beczak | 182/129 |
| 2007/0056999 | A1 * | 3/2007 | Kahn | 224/250 |
| 2010/0258376 | A1 * | 10/2010 | Ward | 181/175 |

* cited by examiner

*Primary Examiner* — James O Hansen
*Assistant Examiner* — Kristine Florio

(57) ABSTRACT

A ladder rung plug is provided for preventing insect infestation of open ended ladder rungs, providing additional storage space, and selectively supporting items from the ladder. The plug assembly includes a ladder having a rung with an open end. A plug is provided having a first end, a second end, and a peripheral edge extending between the first end and the second end. The first end is insertable into the open end of the rung. Thus, the open end may be sealed by the plug. In an embodiment, a wall extends from the first end of the plug forming a storage compartment with an opening through the plug. A cap is selectively couplable to the plug to close the storage compartment.

7 Claims, 5 Drawing Sheets

LADDER RUNG PLUG

BACKGROUND OF THE DISCLOSURE

1. Field of the Disclosure

The disclosure relates to plugging devices and more particularly pertains to a new plugging device for preventing insect infestation of open ended ladder rungs, providing additional storage space, and selectively supporting items from the ladder.

2. Summary of the Disclosure

An embodiment of the disclosure meets the needs presented above by generally comprising a ladder having a rung with an open end. A plug is provided having a first end, a second end, and a peripheral edge extending between the first end and the second end. The first end is insertable into the open end of the rung. Thus, the open end may be sealed by the plug. In an embodiment, a wall extends from the first end of the plug forming a storage compartment with an opening through the plug. A cap is selectively couplable to the plug to close the storage compartment.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
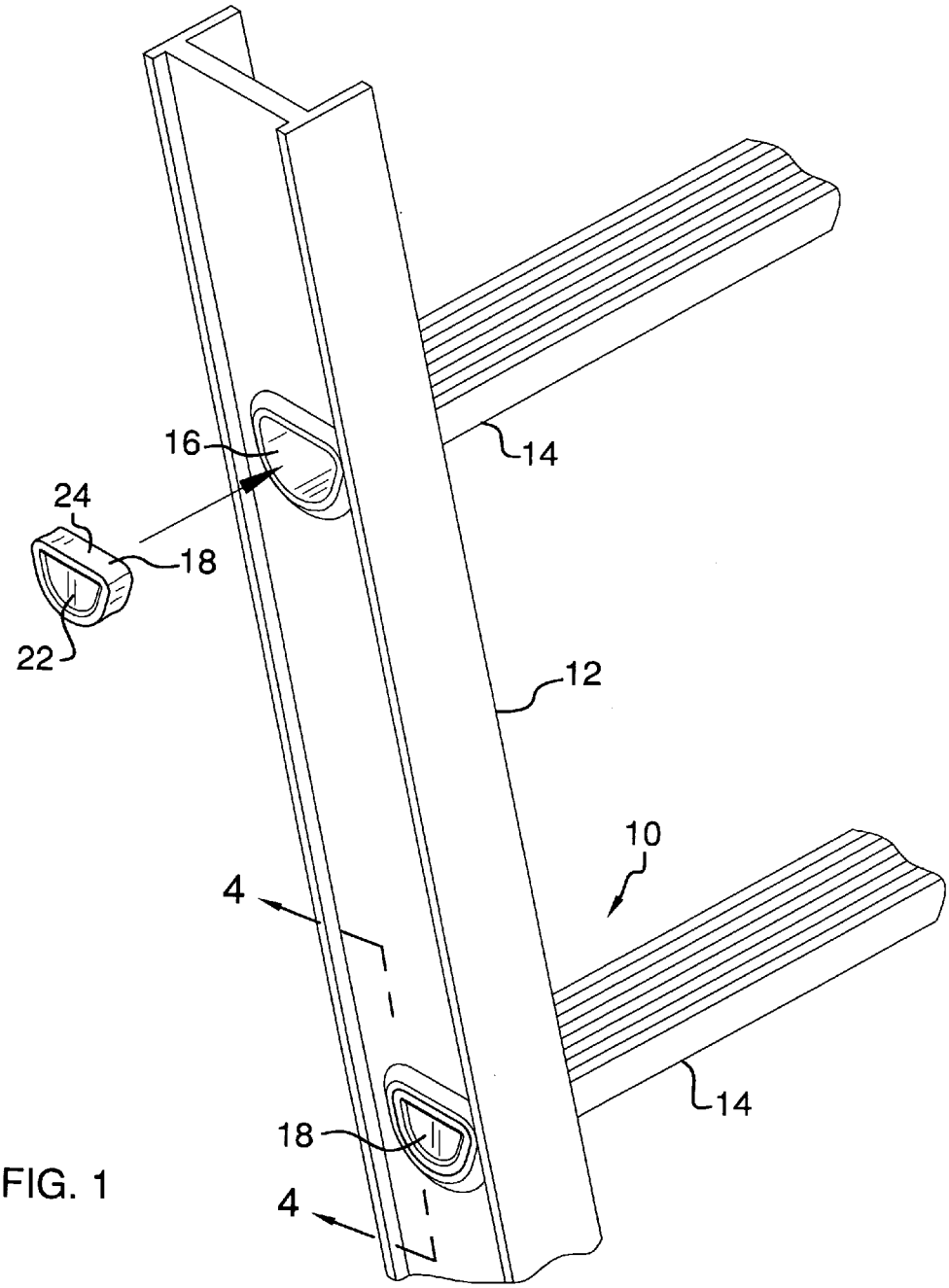
FIG. 1 is a top front side perspective view of a ladder rung plug according to an embodiment of the disclosure.
Figure 2:
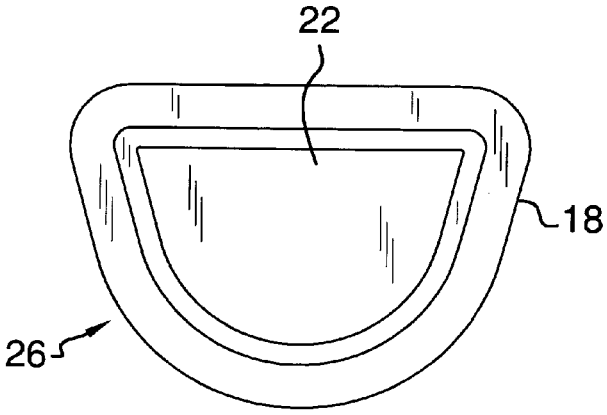
FIG. 2 is a front view of an embodiment of the disclosure.
Figure 3:
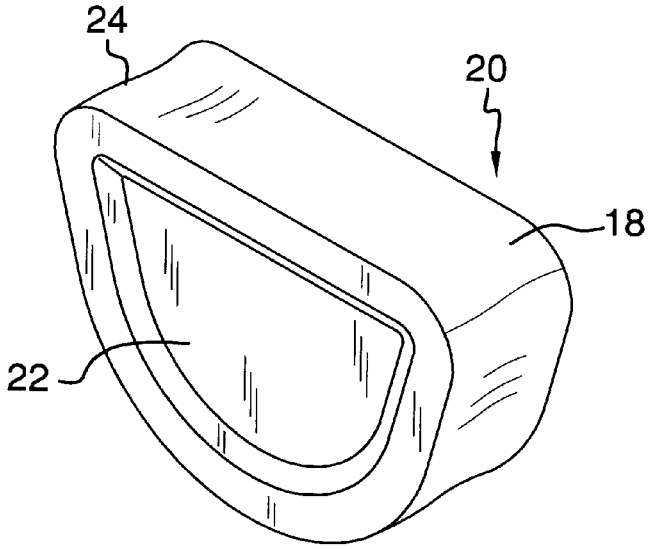
FIG. 3 is a top front side perspective view of an embodiment of the disclosure.

With reference now to the drawings, and in particular to FIGS. 1 through 8 thereof, a new plugging device embodying the principles and concepts of an embodiment of the disclosure and generally designated by the reference numeral 10 will be described.

As best illustrated in FIGS. 1 through 8, the ladder rung plug assembly 10 generally comprises a ladder 12 having a rung 14 with an open end 16. A plug 18 is provided having a first end 20, a second end 22, and a peripheral edge 24 extending between the first end 20 and the second end 22. The first end 20 is insertable into the open end 16 of the rung 14. Thus, the open end 16 may be sealed by the plug 18.

Figure 4:
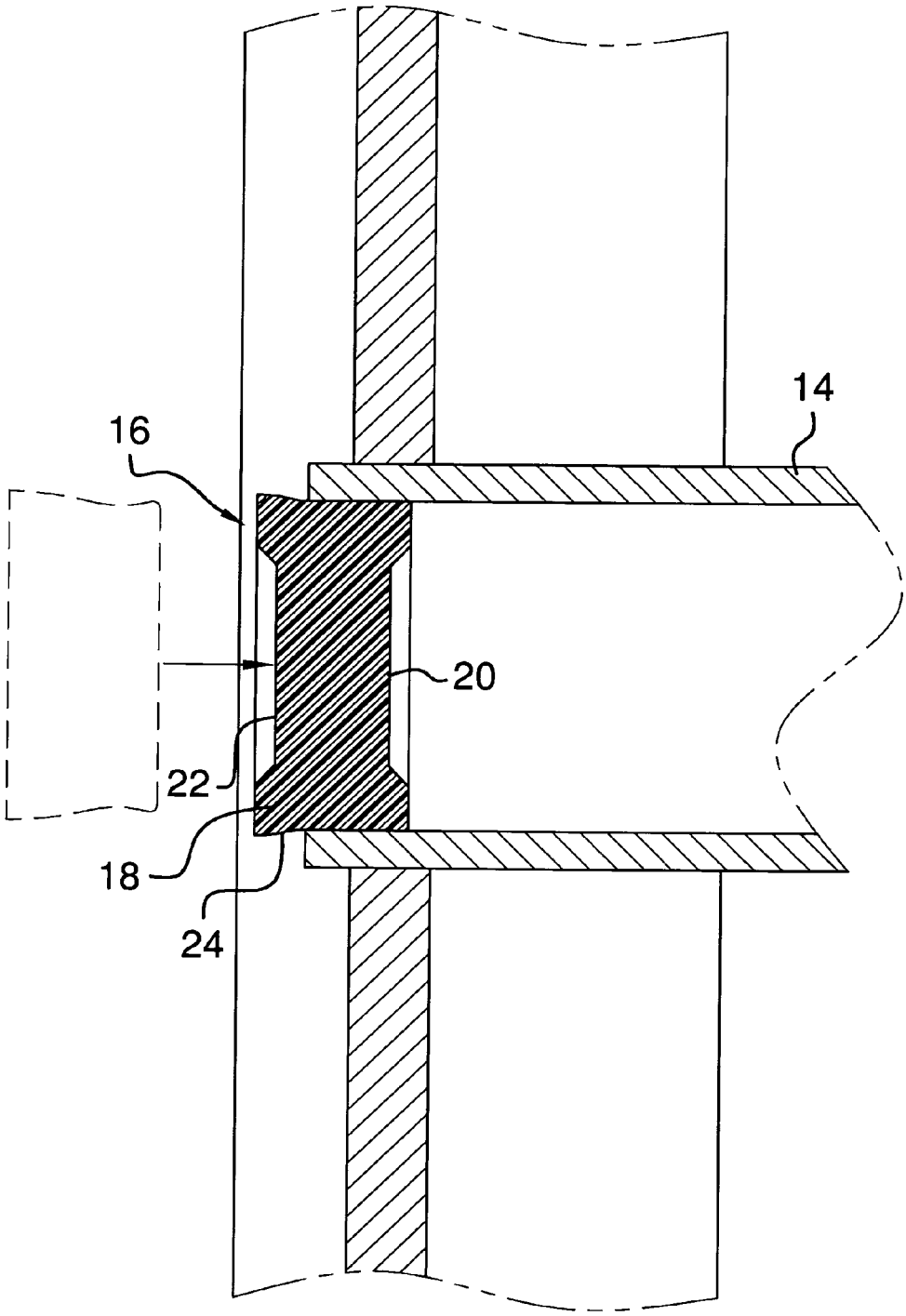
FIG. 4 is a cross-sectional view of an embodiment of the disclosure taken along line 4-4 of FIG. 1.
Figure 5:
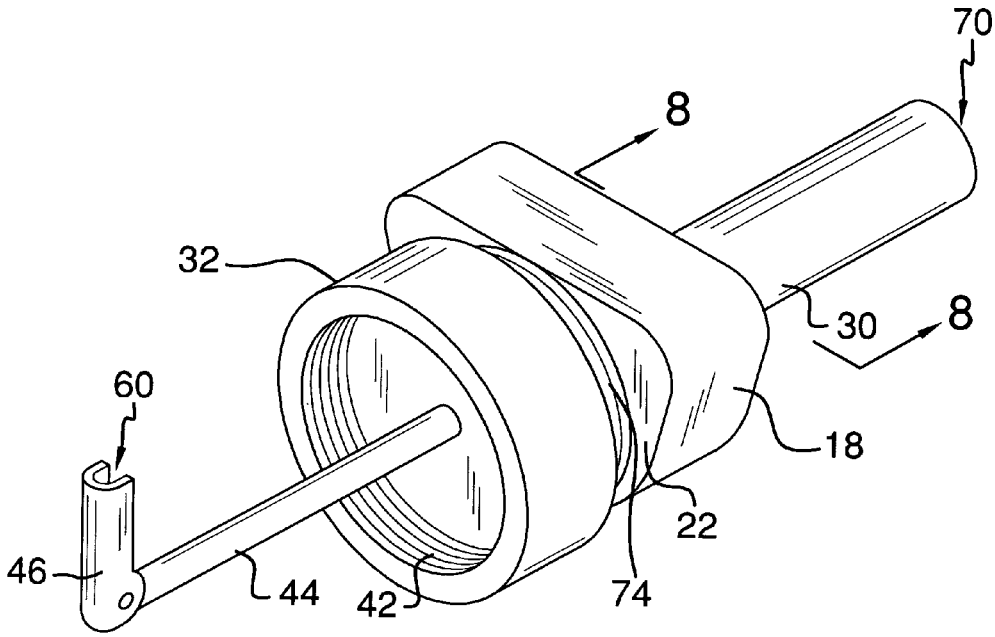
FIG. 5 is a top front side perspective view of an embodiment of the disclosure.
Figure 8:
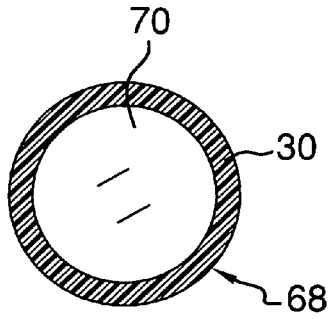
FIG. 8 is a cross-sectional view of an embodiment of the disclosure taken along line 8-8 of FIG. 5.

As shown in FIG. 4, the peripheral edge 24 of the plug 18 may taper from the second end 22 to the first end 20. The plug 18 may also have a D-shaped cross-sectional shape 26 to compliment the shape of the open end 16 of the rung 14.

As shown in FIGS. 5 through 8, the plug 18 may have an annular outwardly threaded extension 74 extending from the second end 22 of the plug 18. A wall 30 may extend from the first end 20 of the plug 18. The wall 30 has a closed perimeter 68 and a closed distal end 70 relative to the first end 20 of the plug 18 forming a storage compartment 34. A central aperture 54 extends through the plug 18 forming an opening 72 into the storage compartment 34.

Figure 6:
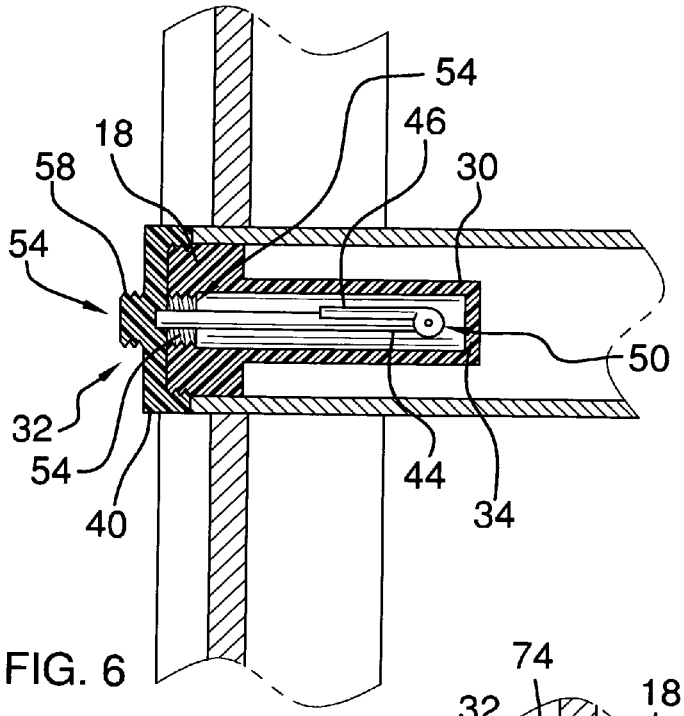
FIG. 6 is a cross-sectional view of an embodiment of the disclosure in a storage position.

A cap 32 is selectively couplable to the plug 18 to close the storage compartment 34 as seen in FIG. 6. The cap 32 has a central disc 38 and a first annular wall 40 extending from the central disc 38. The first annular wall 40 includes inwardly facing threads 42 selectively couplable to the threaded extension 74 of the plug 18.

Figure 7:
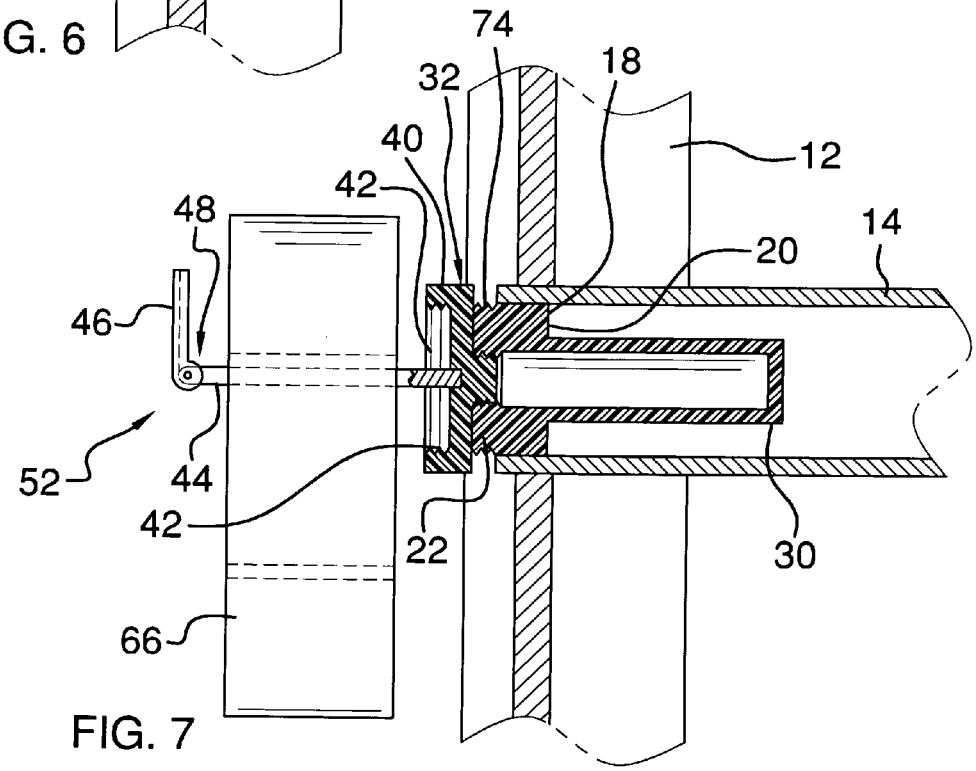
FIG. 7 is a cross-sectional view of an embodiment of the disclosure in a use position.

A support member 44 extends from the central disc 38 such that the support member 44 is positioned in the storage compartment 34 when the first annular wall 40 is coupled to the cylindrical wall 30. A stop member 46 is pivotally coupled to a free end 48 of the support member 44. The stop member 46 is selectively pivotable between a retracted position 50 relative to the support member 44 as shown in FIG. 6 and an extended position 52 relative to the support member 44 as shown in FIG. 7. A second annular wall 56 extends from the central disc 38 of the cap 32. The second annular wall 56 includes outwardly facing threads 58 selectively couplable to the central aperture 54. Thus, the support member 44 may be positioned to extend outwardly with respect to the second end 22 of the plug 18 when the cap 32 is coupled to the central aperture 54. The stop member 46 includes a channel 60. The support member 44 may be positioned in the channel 60 when the stop member 46 is in the retracted position 50.

In use, the open end 16 of the rung 14 of the ladder 12 may be plugged by inserting the first end 20 of the plug 18 into the open end 16. An opposite end of the rung 14 may also be plugged in similar fashion to form a compartment in the ladder rung for storing items. The support member 44 may be attached to the second end 22 of the plug 18 to provide an additional place to hold items such as a roll of tape 66 as shown in FIG. 7. The stop member 46 may be pivoted into the extended position 52 to prevent the tape 66 or other items from accidentally slipping off of the support member 44. During storage of the ladder 12, the support member 44 is positionable in the storage compartment 34 by attaching the first annular wall 40 of the cap 32 to the threaded extension 74 of the plug 18. The storage compartment 34 is then positionable in the rung 14 by inserting the first end 20 of the plug 18 into the open end 16 of the rung 14.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A plug assembly comprising:

a ladder having a rung extending through a leg of ladder;

said rung having an open end;

a plug having a first end, a second end, and a peripheral edge extending between said first end and said second end;

wherein said first end is insertable into said open end of said rung whereby said open end is sealed by said plug;

a wall being attached to and extending from said first end of said plug, said wall having a closed perimeter and a closed distal end relative to said first end of said plug forming a storage compartment, said compartment being extended into said rung when said plug is positioned within said open end of said rung;

a central aperture extending through said plug forming an opening into said storage compartment;

a cap selectively couplable to said plug to close said storage compartment;

said plug having an annular outwardly threaded extension extending from said second end of said plug;

said cap having a central disc;

said cap having a first annular wall extending from said central disc, said first annular wall having inwardly facing threads selectively couplable to said threaded extension of said plug; and a support member extending from said central disc such that said support member is positioned in said storage compartment when said first annular wall is coupled to said threaded extension of said plug.

2. The assembly of claim 1, wherein said peripheral edge of said plug tapers from said second end to said first end.

3. The assembly of claim 1, wherein said plug has a D-shaped cross-sectional shape.

4. The assembly of claim 1, further including a stop member pivotally coupled to a free end of said support member, said stop member being selectively pivotable between a retracted position and an extended position relative to said support member.

5. The assembly of claim 4, wherein said stop member includes a channel, said support member being positioned in said channel when said stop member is in said retracted position.

6. The assembly of claim 1, further including a second annular wall extending from said central disc of said cap, said second annular wall having outwardly facing threads selectively couplable to said central aperture whereby said support member extends outwardly with respect to said second end of said plug when said cap is coupled to said central aperture.

7. A plug assembly comprising:

a ladder having a rung;

said rung having an open end;

a plug having a first end, a second end, and a peripheral edge extending between said first end and said second end, said plug having an annular outwardly threaded extension extending from said second end of said plug;

wherein said first end is insertable into said open end of said rung whereby said open end is sealed by said plug;

wherein said peripheral edge of said plug tapers from said second end to said first end;

wherein said plug has a D-shaped cross-sectional shape;

a wall extending from said first end of said plug, said wall having a closed perimeter and a closed distal end relative to said first end of said plug forming a storage compartment;

a central aperture extending through said plug forming an opening into said storage compartment;

a cap selectively couplable to said plug to close said storage compartment, said cap having a central disc, said cap having a first annular wall extending from said central disc, said first annular wall having inwardly facing threads selectively couplable to said threaded extension of said plug;

a support member extending from said central disc such that said support member is positioned in said storage compartment when said first annular wall is coupled to said threaded extension of said plug;

a stop member pivotally coupled to a free end of said support member, said stop member being selectively pivotable between a retracted position and an extended position relative to said support member, wherein said stop member includes a channel, said support member being positioned in said channel when said stop member is in said retracted position; and a second annular wall extending from said central disc of said cap, said second annular wall having outwardly facing threads selectively couplable to said central aperture whereby said support member extends outwardly with respect to said second end of said plug when said cap is coupled to said central aperture.

* * * * *